United States Patent [19]

Imhoff

[11] 4,049,304

[45] Sept. 20, 1977

[54] SELF-LATCHING FLUSH BOLT

[75] Inventor: William B. Imhoff, Springdale, Conn.

[73] Assignee: Leigh Products, Inc., Coopersville, Mich.

[21] Appl. No.: 749,703

[22] Filed: Dec. 13, 1976

[51] Int. Cl.[2] ..... E05C 1/12

[52] U.S. Cl. ..... 292/333

[58] Field of Search ..... 292/333, 332, 334, 92, 292/175, 337, 335

[56] References Cited

U.S. PATENT DOCUMENTS

| | | | |
|---|---|---|---|
| 1,674,760 | 6/1928 | Carroll | 292/333 X |
| 3,455,591 | 7/1969 | Powers | 292/335 |
| 3,578,369 | 5/1971 | Coopersmith | 292/58 |

*Primary Examiner*—Richard E. Moore
*Attorney, Agent, or Firm*—DeLio and Montgomery

[57] ABSTRACT

A self-latching flush bolt for use in the inactive door of a pair of swinging doors, the bolt being on a slide rod which is spring actuated to throw the bolt into engagement with the strike when the trigger is contacted by the active door. A dead-locking lever holds the bolt locked as long as the trigger is depressed; when the active door is opened the bolt may be manually retracted and will be held in retracted position until the trigger is activated. A roller on the bottom bolt rolls on the floor in case the bolt is thrown with the door in an open position.

7 Claims, 7 Drawing Figures

SELF-LATCHING FLUSH BOLT

This invention relates to a self-latching flush bolt for latching the inactive one of a pair of swinging doors. The actuation of the bolt is effected in certain positions by the engagement of the active door with a trigger on the inactive door and, in other positions, by manual operation of a slide.

Extension flush bolts are commonly used in pairs, associated with a pair of swinging doors to latch one of the doors, referred to as the inactive door, at the top and bottom thereof. The bolts of these latch mechanisms when retracted are flush or substantially flush with the respective upper and lower edges of the inactive door. One bolt is adapted to engage in a strike located in the door sill while the other bolt engages in a strike located in the door frame above the door. The other door of the pair is referred to as the active door, carrying a latch mechanism adapted to cooperate with a strike in the edge of the inactive door, the latch mechanism being operated manually by knobs, for example.

Prior extension flush bolt mechanisms have embodied various combinations of capabilities, as desired by the respective designers to meet various requirements. Thus the bolt shown in Coopersmith Pat. No. 3,578,369 is latched and unlatched by positive mechanical action as the trigger is actuated or released; the bolts shown in the patents to Toney, No. 1,338,713 and Powers, No. 3,455,591, are automatically latched when the active door is closed and must be manually released. The capabilities of the present bolt are similar to those of the two bolts just mentioned but there are significant improvements in, and addition to, the mechanism.

It is accordingly an object of the invention to provide a flush bolt mechanism wherein the bolt is continuously biased toward engaged position, together with dead-locking means for holding the bolt in engaged position so long as the trigger is depressed.

It is a further object of the invention to provide a flush bolt mechanism wherein the trigger, when not depressed, engages the bolt rod to hold the bolt positively in retracted position.

It is another object of the invention to provide a flush bolt mechanism wherein the bottom bolt includes a roller to prevent damage to the floor in case the bolt is accidentally released with the door in open position.

It is a still further object of the invention to provide certain improvements in the form, construction and arrangement of the several parts whereby the above-named and other objects may effectively be attained.

A practical embodiment of the invention is shown in the accompanying drawings, wherein.

Figure 1:
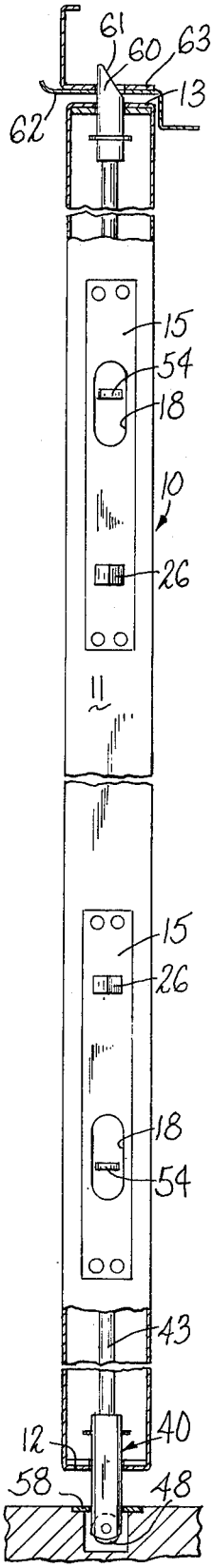
FIG. 1 represents an edge view of an inactive door in closed position, parts being broken away and in section to show the engagement of the bottom and top bolts with their respective strikes.

Referring to the drawings, the inactive door 10 is shown as being hollow and made with an edge wall 11, bottom wall 12 and top wall 13. Details of construction of the door and the manner of mounting the flush bolt mechanism therein are conventional and need not be described. The bottom and top bolt mechanisms are identical, except for the form of the bolt heads, so that only the bottom bolt mechanism will be described in detail.

Figure 4:
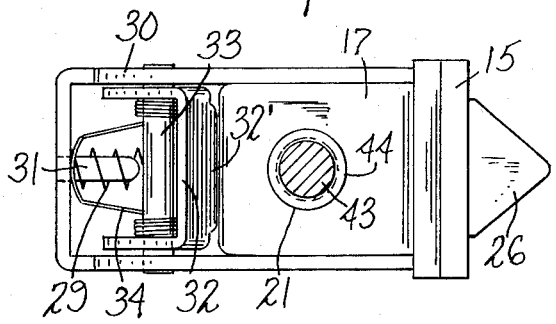
FIG. 4 represents a horizontal section on the line IV—IV of FIG. 3, looking in the direction of the arrows.

The bolt mechanism frame comprises a plate 15, adapted for installation with its face flush with the edge 11 of the door and provided with an upper bearing block 16, a lower bearing block 17 and a vertical slot 18 intermediate the two blocks. The upper block is traversed vertically by a cylindrical bore 19 and horizontally by a bore 20 of rectangular cross-section, intersecting the bore 19. The lower block 17 is traversed vertically by the bore 21, aligned with the bore 19. The trigger 24 has a horizontally elongated body portion traversed vertically by a slot 25 and adapted for free sliding engagement in the bore 20, a double-beveled nose portion 26 and a downwardly projecting tail piece 27 at its rear end. The rear end is also provided with a socket 28 to receive one end of a spring 29 which is in compression between the base of the socket and the inner wall of a housing 30, U-shaped in plan view (FIG. 4), which encloses the upper block on which it is mounted. A tab 31 is cut from the housing wall and bent in 90° as a guide and support for the spring 29.

The dead-lock plate 32 is pivotally supported on a rod 33 extending horizontally between the side walls of the housing 30 and a spring 34 biases the plate 32 to keep the upper end 32' of the plate in contact with the tail piece 27, the angle of the plate thus being a function of the position of the trigger.

The bolt assembly comprises the bolt itself 40, which is non-circular in cross-section with at least two flat parallel sides 41,42, the bolt rod 43 one end of which is screwed into the threaded socket in the upper end of the bolt, and the sleeve 44 which is screwed onto the upper end of the rod and which terminates in the tapered head 45, projecting slightly into slot 24, below which the sleeve is necked in at 46 to form an annular flange enabling the trigger to hold the bolt in unlocked position, as explained below. The bolt 40 passes with a free sliding fit through the bracket 47, fixed on the bottom wall 12 of the door. The bottom end of the bolt is preferably bifurcated and provided with the roller 48 which turns on an axis parallel to the plane of the door.

For manual actuation of the bolt a slide 50 is arranged to engage the sleeve 44 by means of upper and lower flanges 51, 52, each vertically bored and traversed by the sleeve, the flange 51 being fixed on the sleeve by a pin 53. The slide is formed with a finger piece 54 extending into the vertical slot 18 so as to be accessible for manipulation when the edge of the door is exposed. A spring 55 under compression between the lower flange 52 and a washer or plate 56 at the bottom of the housing 30 biases the slide, and the bolt assembly on which the slide is mounted, downward toward door locking position, wherein the bolt engages a strike 58 set in the floor or in a door sill.

If the door 10 is provided with a top bolt mechanism, as is customary, such mechanism is the same as the bottom bolt mechanism just described except that the bolt 60 has a beveled face 61 for snap-locking in the strike 62 on the top frame 63 of the door, if the door is closed with the bolt extended.

The threaded engagement of the rod 43 with the bolt 40 at one end and the sleeve 44 at the other end makes possible very accurate vertical adjustment of the bolts through a relatively wide range.

Figure 2:
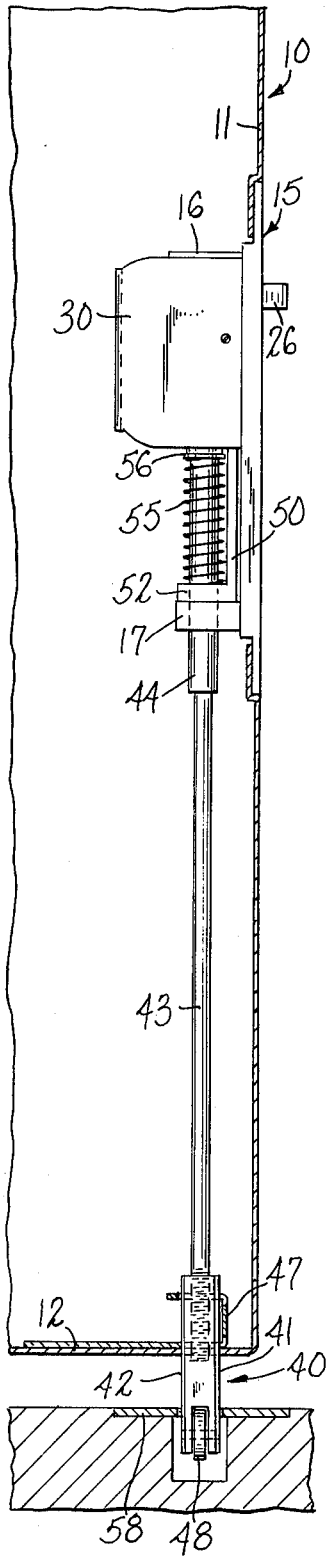
FIG. 2 represents a side elevation of the bottom bolt mechanism in engaged position, parts of the door, floor and strike being in section.
Figure 3:
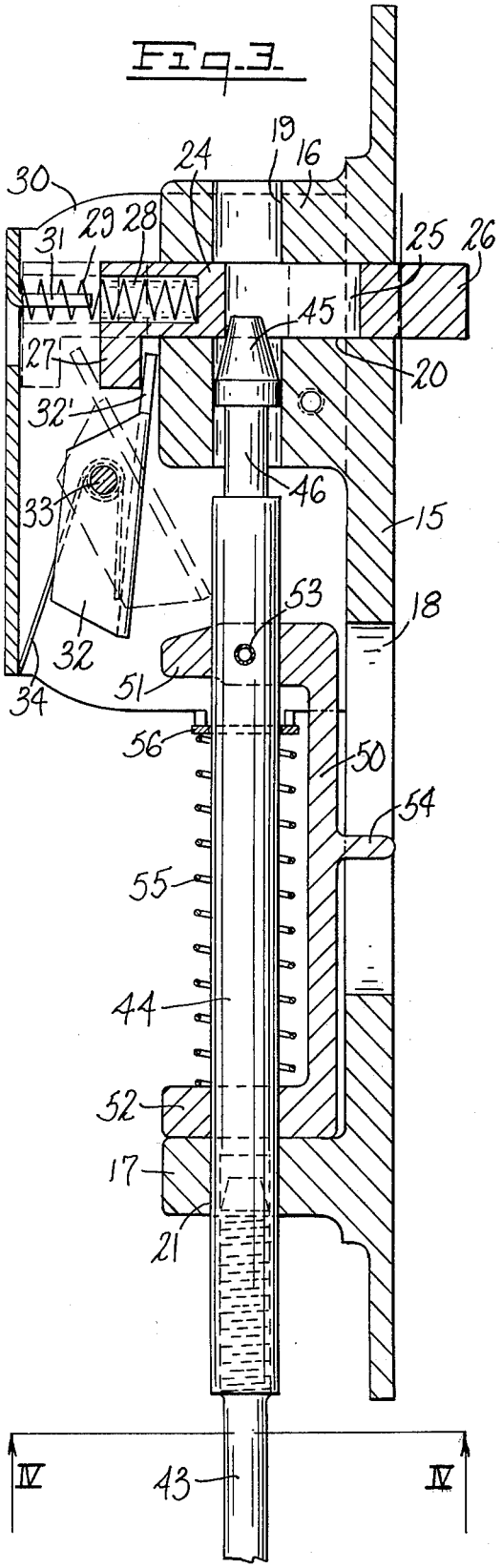
FIG. 3 represents a vertical section through the operating mechanism of the bottom bolt, the bolt being in engaged position.
Figure 5:
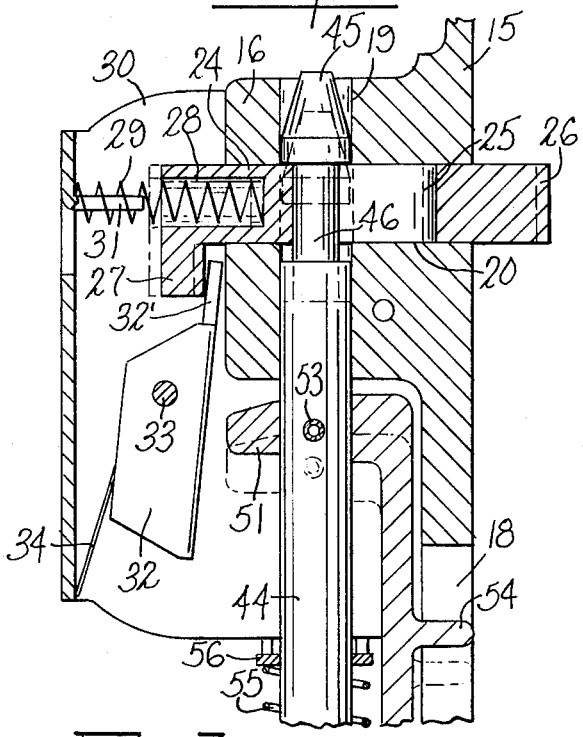
FIG. 5 represents a detail vertical section as in FIG. 3 showing the bolt rod in retracted position.
Figure 6:
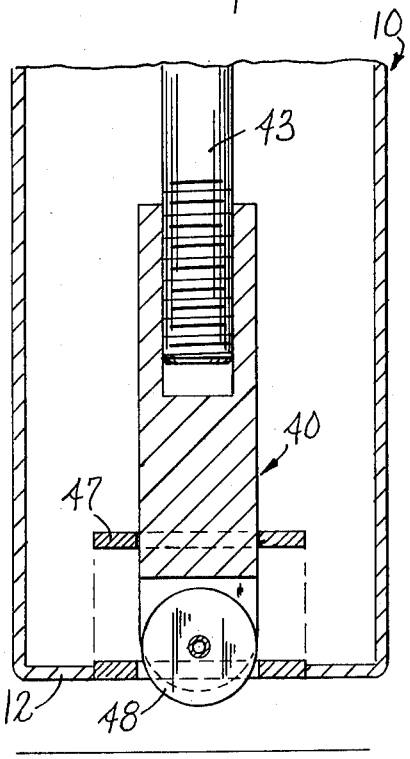
FIG. 6 represents a detail vertical section through the bottom bolt and adjacent door elements, the bolt being retracted.
Figure 7:
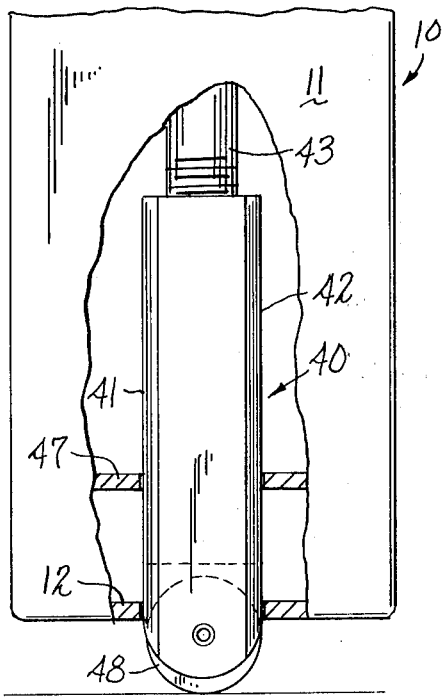
FIG. 7 represents an elevation, parts being broken away, showing the bottom bolt released and its roller resting on the floor.

The options available for operation of the bolt described above include the following:

With the inactive door locked, as shown in FIGS. 1, 2 and 3, and the active door open, the inactive door may be unlocked manually by means of the finger pieces, the slide 50 being raised by the finger piece 54, causing the tapered head 45 to cam its way past the end of the slot 25 (partially retracting the trigger) until its slower edge clears the upper edge of the slot, when the trigger returns to its extended position, as shown in FIG. 5, with the head 45 held in the bolt-retracted position (FIGS. 5 and 6). Assuming the top bolt 60 to be similarly retracted, the door is free to open and close and cannot be locked manually by means of the finger piece. The bolt will, however, be extended automatically if the trigger 24 is pushed in, either accidentally or deliberately. If this should occur when the door is not in its closed position, the roller 48 will rest on the floor and the door can be moved to closed or other positions without injury to the floor surface, even if the bolt is not again retracted manually, as just described.

With the inactive door locked, as shown in FIGS. 1, 2 and 3, the active door may be closed, with action pushes the trigger in to the broken line position of FIG. 3, permitting the dead-lock plate 32 to move to its locking position, also shown in broken lines in FIG. 3, wherein its lower edge lies in the path of upward movement of the flange 51 on slide 50. Thus, although the head 45 on the bolt rod sleeve is free to move through the slot 25, such motion is prevented by the position of the dead-lock plate, and the inactive door cannot be opened until the active door has been moved out of the path of the trigger nose 26.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. A self-latching flush bolt for use in the inactive door of a pair of swinging doors comprising, a bolt mechanism frame adapted for mounting in the edge of a door and including a flat plate and upper and lower bearing blocks extending inward from said plate, the plate being traversed by a vertically elongated slot, the upper block being traversed by intersecting vertical and horizontal bores and the lower block being traversed by a vertical bore aligned with the vertical bore in the upper block, a trigger slidably mounted in said horizontal bore, the trigger having a slot adapted to be moved into and out of register with the vertical bore in the upper block, and a bolt assembly having a bolt at one end adapted for installation adjacent a top or bottom edge of the door, a head at the other end and a rod-like element connecting the bolt to the head, means retaining the head within said last named vertical bore for vertical reciprocation therein between positions corresponding to engaged and disengaged positions of the bolt, and the head being engageable with an edge of said trigger slot to retain the bolt in disengaged position.

2. A self-latching flush bolt according to claim 1 wherein the rod-like element comprises a rod adjustably connected to the bolt and a sleeve adjustably mounted on the rod and terminating in a distally tapered head having an oppositely facing flange, said flange being engageable with the edge of the trigger slot.

3. A self-latching flush bolt according to claim 1 wherein the means retaining the head comprises a slide fixed on the rod-like element and having portions adapted to contact the upper and lower blocks, respectively, to limit the vertical movement of the rod-like element.

4. A self-latching flush bolt according to claim 3 wherein the slide is provided with a finger piece extending into the vertical slot in the plate.

5. A self-locking flush bolt according to claim 3 which includes a dead-lock plate pivotally supported in a position to swing into and out of a locking position engaging the slide and having a portion engageable by the trigger to control said swinging movement.

6. A self-locking flush bolt according to claim 1 wherein the bolt is provided with a roller.

7. A self-locking flush bolt according to claim 6 wherein the roller is mounted for rotation on an axis parallel to the plane of a door on which the bolt is to be installed.

* * * * *